United States Patent [19]

Dunnegan

[11] Patent Number: 4,925,359

[45] Date of Patent: May 15, 1990

[54] QUADFLEX BUCKET APPARATUS

[76] Inventor: Garry W. Dunnegan, 1310 E. Gretchen, Wichita, Kans. 67206

[21] Appl. No.: 189,217

[22] Filed: May 2, 1988

Related U.S. Application Data

[63] Continuation-in-part of Ser. No. 886,877, Jul. 18, 1986, abandoned.

[51] Int. Cl.[5] ..... E02F 3/04

[52] U.S. Cl. ..... 414/722; 414/704; 414/732; 414/739

[58] Field of Search ..... 414/704, 722, 724, 725, 414/726, 732, 739; 294/104, 105, 106, 107

[56] References Cited

U.S. PATENT DOCUMENTS

| | | | |
|---|---|---|---|
| 3,305,118 | 2/1967 | Lull | 414/704 |
| 3,485,396 | 12/1969 | Lundquist | 414/732 |
| 3,669,293 | 6/1972 | Bryan et al. | 414/704 |
| 4,106,646 | 8/1978 | Weisgerber | 294/88 X |
| 4,309,142 | 1/1982 | Shumaker | 414/722 |
| 4,790,717 | 12/1988 | Anderson | 414/722 |

*Primary Examiner*—Robert J. Spar
*Assistant Examiner*—William M. Hienz
*Attorney, Agent, or Firm*—John W. Carpenter

[57] ABSTRACT

A quadflex bucket apparatus operable to grasp and lift loose piles of material. The quadflex bucket apparatus comprises a lower jaw assembly with at least one finger member pivotally secured thereto. An upper jaw assembly is pivotally secured to the middle jaw assembly. A pair of first hydraulic cylinders is pivotally secured to the lower jaw assembly and to the middle jaw assembly. A pair of second hydraulic cylinders is pivotally secured to the middle jaw assembly and to the upper jaw assembly.

12 Claims, 7 Drawing Sheets

FIG. 1
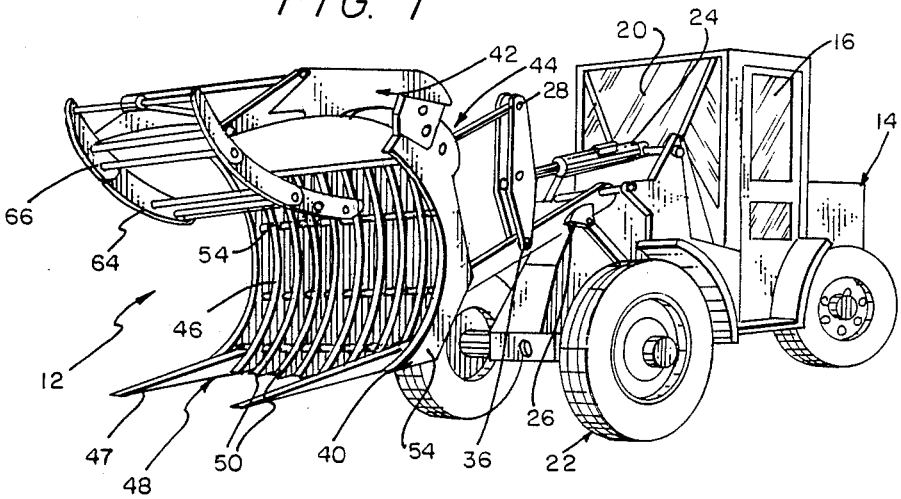
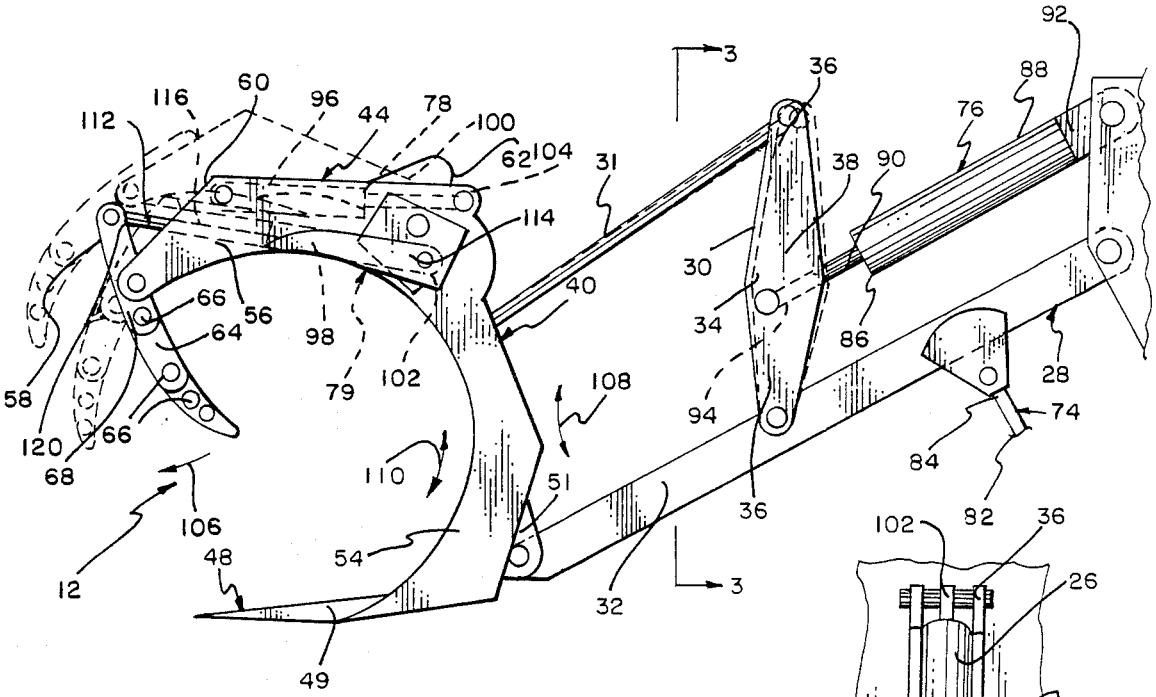
FIG. 2
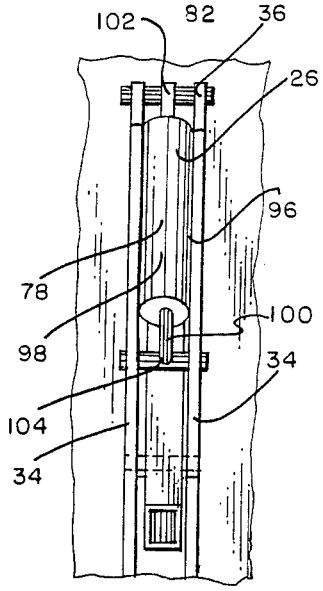
FIG. 3

FIG. 11
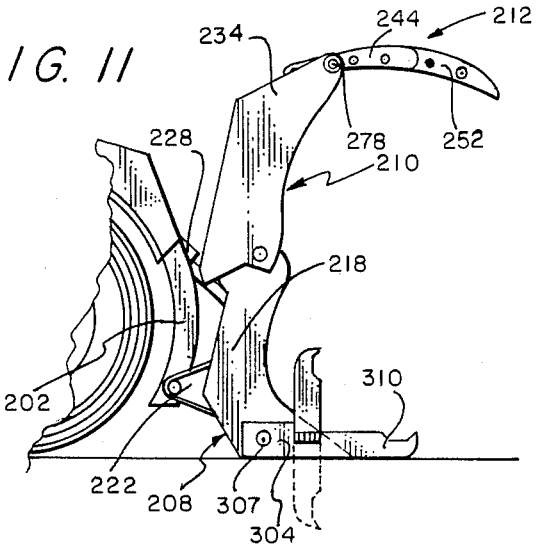
FIG. 12
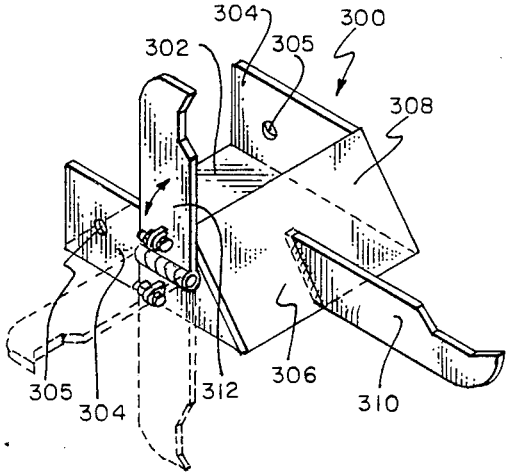
FIG. 15
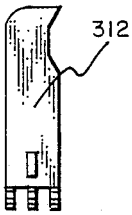
FIG. 14
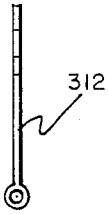
FIG. 13
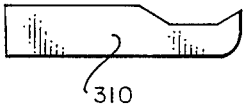
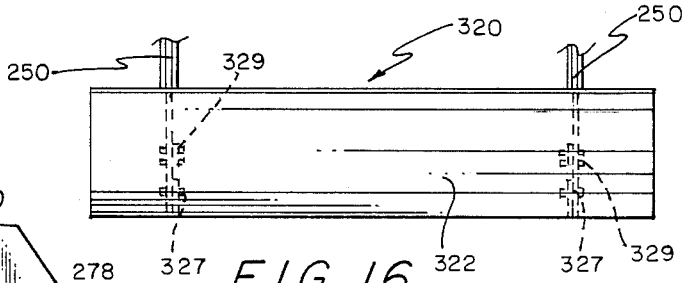
FIG. 16
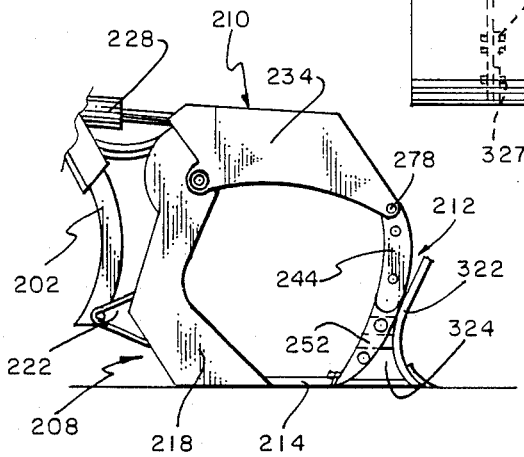
FIG. 17
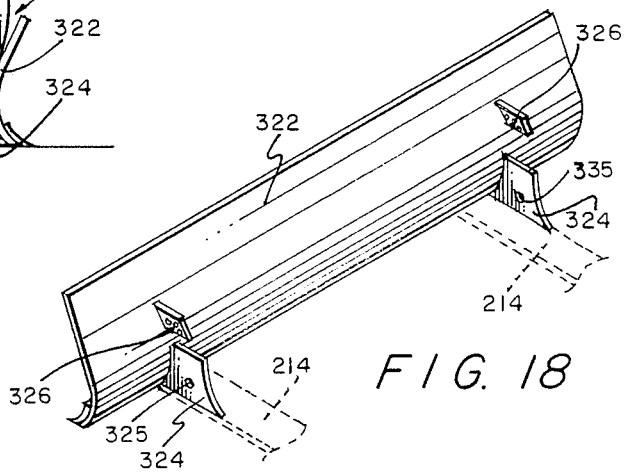
FIG. 18

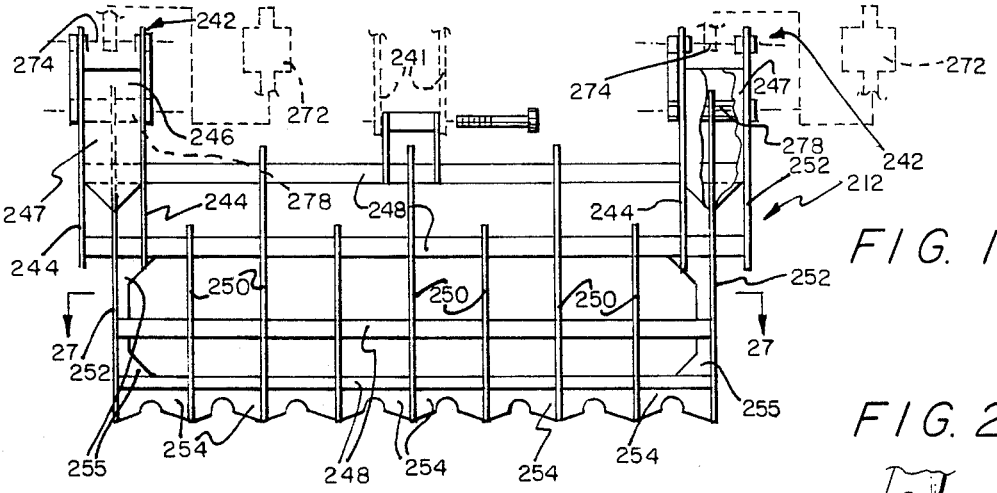
FIG. 19
FIG. 22
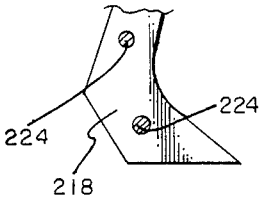
FIG. 20
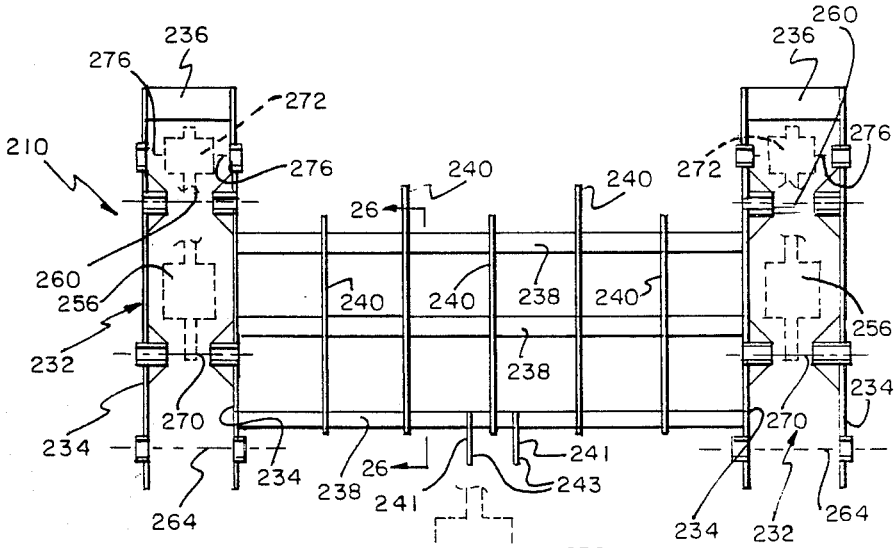
FIG. 21
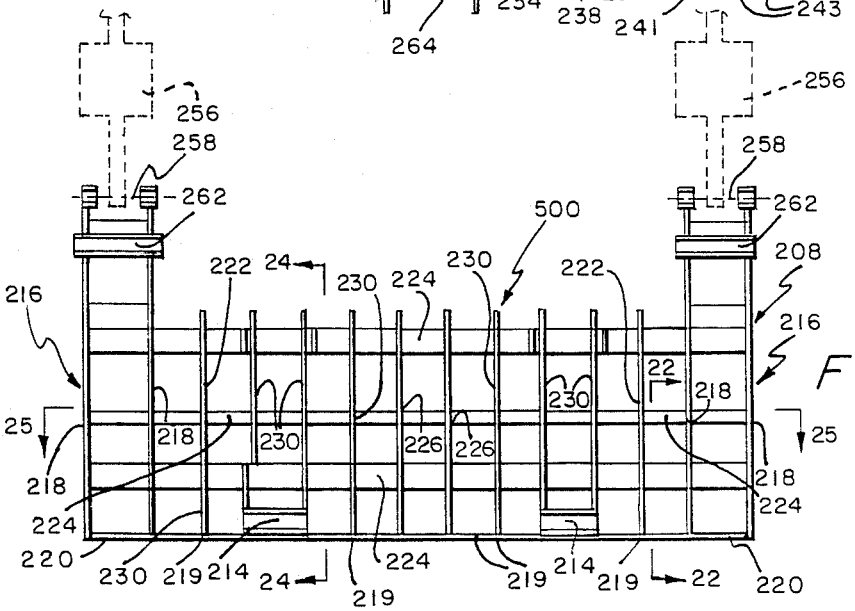

FIG. 27
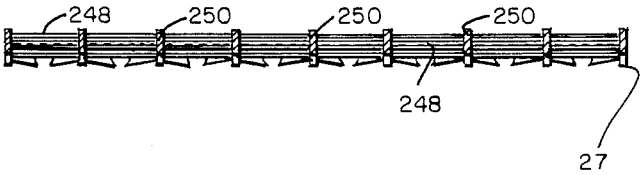
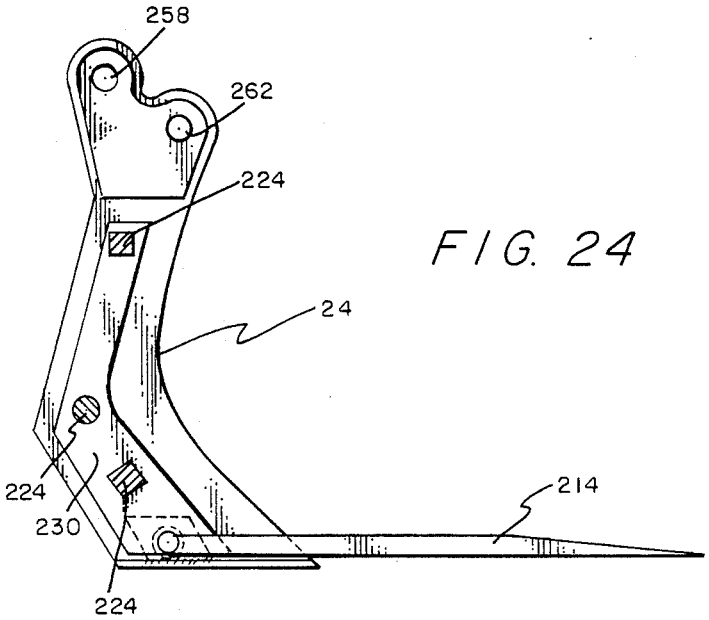
FIG. 24
FIG. 26
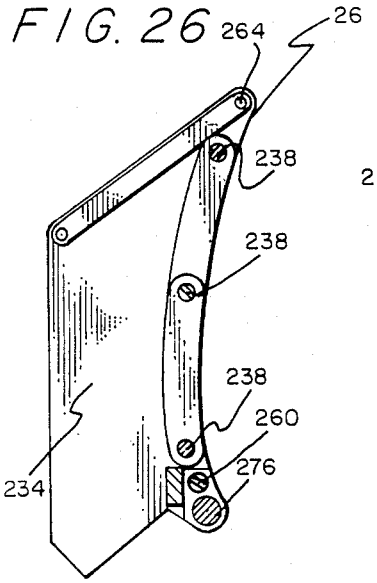
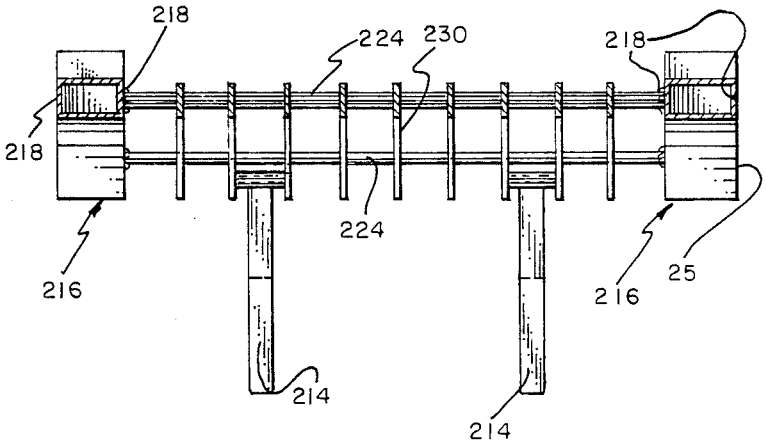
FIG. 25

QUADFLEX BUCKET APPARATUS

This is a continuation-in-part application of application having Ser. No. 886,877, filed July 18, 1986, now abandoned.

PRIOR ART

It is noted that the applicant has filed a U.S. patent application on this invention as a co-inventor entitled "Triflex Bucket", Ser. No. 281,379, filed July 9, 1981, which has gone abandoned. The patent application herein is a substantial improvement over the prior subject abandoned patent application and the inventor herein is the sole inventor of such improvements. The prior pending application was rejected under a Peterson reference of which we do not have the number or a copy thereof as other patent counsel was involved. This reference is not deemed pertinent to the claimed invention set forth hereinafter.

Additionally, from the subject abandoned patent application, we note the following U.S. Pat. Nos. 2,862,756 and 3,125,234 were discussed. The following known information in regard to these patents as set forth in abandoned patent application No. 281,379 is as follows:

A grasping function, however, is found in the conventional clam chell bucket. This type of bucket or grapple is normally utilized with, for example, a drag line where it may be raised or lowered. The jaws are opened and closed to grasp the material to be moved. In, for example, U.S. Pat. No. 2,862,756, such a device is shown wherein opposed, semi-circular jaws are provided which are opened and closed by hydraulic cylinders. The central pivot point or support mounts each opposed jaw about a hinge connection. Typically, this type of bucket is not pivotally mounted about a support but rather is raised and lowered.

In U.S. Pat. No. 3,125,234, there is described a material handling machine including a front end loader bucket which approximates a grasping function while retaining a blade like member on the lower jaw similar to a conventional bucket. In this device, upper and lower jaws are provided, and these jaws are hingedly interconnected. The lower jaw is substantially a reverse J shape with a blade extension member at the distal portion thereof. The support mechanism for the prime mover includes a means for pivoting the lower jaw member to alter the angle of attack of the blade members. The upper jaw, however, is semi-circular and generally extends from the pivotal connection, to the blade member when the jaw is closed. A flexing action is approximated only by the scooping action of the lower jaw member coupled with closing the upper jaw member on the lower jaw member. However, a true flexing action is not provided by the semi-circular upper jaw member.

PREFERRED EMBODIMENT OF THE INVENTION

In one preferred embodiment of the invention, a quadflex bucket apparatus is provided adapted to be attached to a prime mover such as a front end loader structure and being operable to grasp, lift, and convey material such as shredded or coiled machine aluminum scrap and the like. The quadflex bucket apparatus includes (1) a base support jaw assembly; (2) a main flexible jaw assembly connected to the base support jaw assembly; and (3) a power actuator assembly operably connected to the base support jaw assembly and the main flexible jaw assembly. The base support jaw assembly includes a main base assembly having a lift arm assembly pivotally connected thereto. The main base assembly is moved vertically, arcuately, and laterally through operation of the power actuator assembly. The lift arm assembly includes a plurality of finger members which are adapted to pivot in an upward direction relative to the main base assembly. The main flexible jaw assembly includes an upper jaw assembly and a pivotal lift arm assembly. The upper jaw assembly is pivotally connected to an upper end of the main base assembly so as to move within an opened and closed relationship relative to the main base assembly. The pivotal lift arm assembly is provided with a plurality of outer pivotal finger members which are operable to be pivoted inwardly and outwardly in a grasping motion. The power actuator assembly includes a vertical, base, and flex jaw actuator assemblies bieng hydraulic and piston cylinder members operable to move the various elements thereof. The quadflex bucket apparatus of this invention is operable similar to a person's hand in grasping action with the lower lift arm assembly acting similar to a person's thumb so as to be used to readily pick up loose material such as shredded aluminum and other metal machining debris and scrap material in an efficient and effective manner.

OBJECTS OF THE INVENTION

One object of this invention is to provide a quadflex bucket apparatus which can be readily attached to a prime mover such as a front end loader structure and having flexible jaw assemblies connected to a base support jaw assembly being operable in a manner to surround and grasp the material to be lifted and transported thereby.

One other object of this invention is to provide a quadflex bucket apparatus including a base support jaw assembly having a lift arm assembly pivotally movable about a main base assembly so that the lift arm assembly can be placed under the material to be lifted or can be moved to an inactive position when not desired or needed for a particular lifting operation.

Another object of this invention is to provide a quadlfex bucket apparatus being attachable to a prime mover including three jaw assemblies operably connected to a main base assembly and being operable through a power actuator assembly so as to surround, grasp, lift, and transport scrap material such as aluminum or steel machine shavings and the like.

Another object of this invention is to provide a quadflex bucket apparatus which will act like a person's thumb and finger enabling the operator to remove, lift, pinch, or grasp various sized objects in tornado disasters or terrorist bombing actions which could save time and lives in disaster situations with speed and efficiency.

Still one further object of this invention is to provide a quadflex bucket apparatus which is operable to be placed under, surround, and grasp loose material similar to the use of a person's hand which is highly effective and efficient in scrap metal operations not requiring the conventional crane and magnetic lift structures thus achieving a substantial cost saving operation.

One other object of this invention is to provide a quadflex bucket apparatus including a base support jaw assembly having flexible jaw assemblies pivotally connected thereto with all of the jaw assemblies having spaced, vertically, extended, adjacent, narrow jaw members allowing the operator an open, clear forward view through the jaw assemblies.

Still another object of this invention is to provide a quadlfex bucket apparatus which is sturdy in construction, easy to operate, relatively economical to manufacture, time saving in operation and substantially maintenance free.

Various other objects, advantages, and features of this invention will become apparent to those skilled in the art from the following discussion, taken in conjunction with the accompanying drawings, in which:

FIGURES OF THE INVENTION

FIG. 1 is a perspective view of the quadflex bucket apparatus of this invention as attached to a prime mover or front end loader structure;

FIG. 2 is a side elevational view of the quadflex bucket apparatus of this invention illustrating movements thereof in dotted lines and showing a fragmentary view of the primer mover structure;

FIG. 3 is a fragmentary sectional view taken along line 3—3 in FIG. 2;

FIG. 11 is a side elevational view of the quadflex bucket apparatus having a boot slidably disposed on the lower jaw assembly;

FIG. 12 is a perspective view of the boot with the front projecting ripping finger and the side ripping finger pivotally secured thereto;

FIG. 13 is a side elevational view of the front projecting ripping finger of the boot;

FIG. 14 is a side elevational view of the side ripping finger;

FIG. 15 is a front elevational view of the side ripping finger;

FIG. 16 is a front elevational view of the grading apparatus;

FIG. 17 is a side elevational view of the quadflex bucket having the grading apparatus secured thereto;

FIG. 18 is a perspective view of the grading apparatus;

FIG. 19 is a front elevational view of the upper jaw assembly;

FIG. 20 is a top plan view of the middle jaw assembly;

FIG. 21 is a front elevational view of the lower jaw assembly; and

FIG. 22 is a vertical sectional view taken in direction of the arrows and along the plane of line 22—22 in FIG. 21.

FIG. 24 is a vertical sectional view taken in the direction of the arrows and along the plane of line 22—22 in FIG. 21.

FIG. 25 is a horizontal sectional view taken in the direction of the arrows and along the plane of line 25—25 in FIG. 21.

FIG. 26 is a vertical sectional view taken in the direction of the arrows and along the plane of line 26—26 in FIG. 20.

FIG. 27 is a horizontal sectional view taken in the direction of the arrows and along the plane of line 27—27 in FIG. 19.

Figure 4:
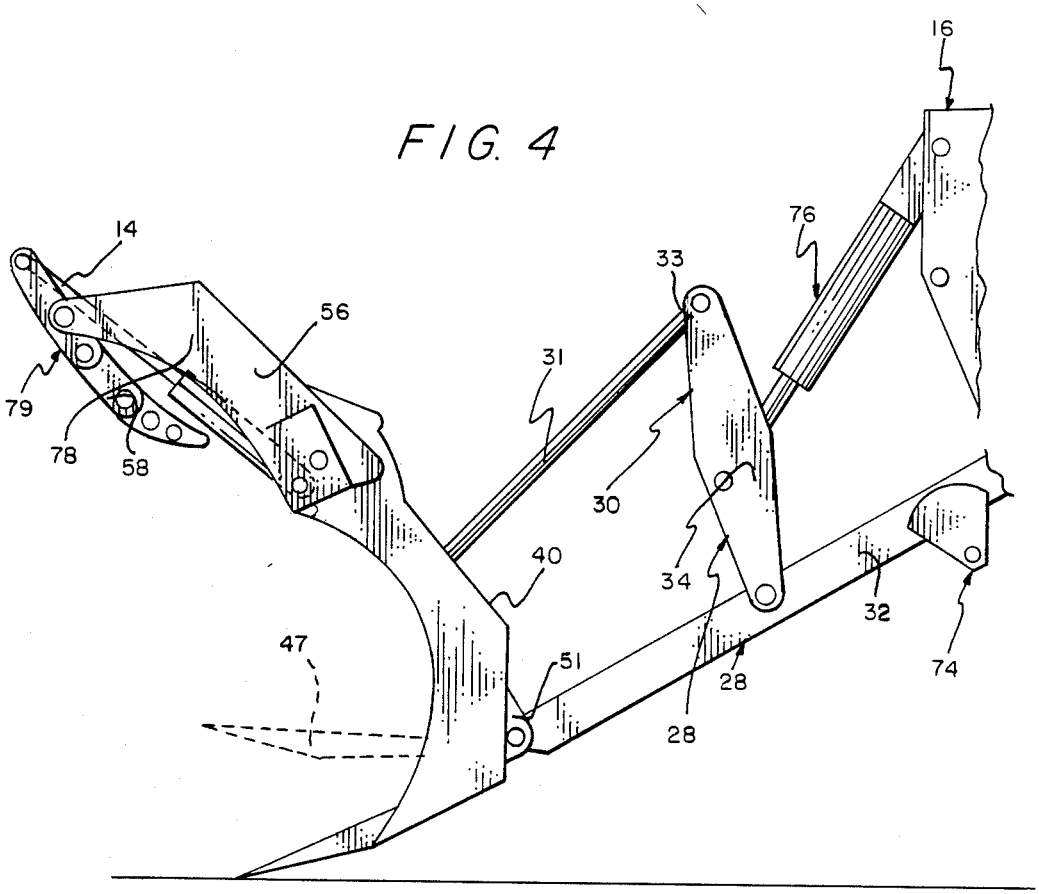
FIGS. 4 and 5 are side elevational views similar to FIG. 2 illustrating use and operation of the quadflex bucket apparatus of this invention.

The following is a discussion and description of preferred specific embodiments of the quadflex bucket apparatus of this invention, such being made with reference to the drawings, whereupon the same reference numerals are used to indicate the same or similar parts and/or structures. It is to be understood that such discussion and description is not to unduly limit the scope of the invention.

DESCRIPTION OF THE INVENTION

On referring to the drawings in detail and in particular to FIG. 1, a quadflex bucket apparatus, indicated generally as 12, is shown attached to a prime mover or front end loader structure 14. It is obvious that the quadflex bucket apparatus 12 can be attached to the front end of numerous prime mover structures such as tractors, tractors specifically of the CATERPILLAR type, and the like having lift arm structures and a hydraulic power source.

The prime mover or front end loader 14 includes (1) a power tractor assembly 16; (2) an attachment control assembly 18 connected to the power tractor assembly 16. The power tractor assembly 16 includes a conventional cabin assembly 20 mounted on a drive wheel assembly 22 and having a conventional hydraulic control assembly 24 therein. The hydraulic control assembly 24 would include a plurality of actuator levers (not shown) which are operable to selectively raise and lower a portion of the attachment control assembly 18.

The attachment control assembly 18 includes a power drive assembly 26 connected to a lift linkage assembly 28. The power drive assembly 26 includes piston and cylinder members operable through a hydraulic fluid drive system and power system as will be explained in detail.

The lift linkage assembly 28 includes (1) a pair of spaced, vertical lift links 32; (2) a clamp link assembly 30 connected at one end to the vertical lift links 32; and (3) a connector rod 31 interconnecting an upper portion of the lift link assembly 30 to the quadflex bucket apparatus 12 as will be explained.

The vertical lift links 32 are operable to be pivotally connected at one end to the prime mover or front end loader 14 and at the opposite end to the quadflex bucket apparatus 12 to raise and lower same.

The clamp link assembly 30 includes an intermediate link member 34 having one end section 36 pivotally connected to the respective vertical lift links 32 and a center section 38 which is attached at 39 to the power drive assembly 26.

The connector rod 31 is provided with outer connector portions 33 with one thereof pivotally connected to the upper end of the intermediate link member 34 and the opposite end is pivotally connected to the quadflex bucket apparatus 12.

The quadflex bucket apparatus 12 includes (1) a base support jaw assembly 40; (2) a main flexible jaw assembly 42 pivotally connected to the base support jaw assembly 40; and (3) a power actuator assembly 44 operably connected between the main flexible jaw assembly 42 and the base support jaw assembly 40 in order to provide for power operation of the various jaw and finger members as will be explained in detail.

The base support jaw assembly 40 includes a main base assembly 46 having a lift arm assembly 48 pivotally connected thereto. The main base assembly 46 includes a plurality of parallel, adjacent jaw members 50 interconnected by transverse support rods 52 and having heavy duty outer jaw members 54 at the outer ends of the support rods 52. The spaced jaw members 50 allow for an open, clear view by the equipment operator. A pair of the adjacent jaw members 50 on each opposite end have laterally extended anchor sections 51 adapted to pivotally receive the pivotal connections of the vertical lift links 32 and the connector rods 31 as noted in FIG. 4.

Figure 5:
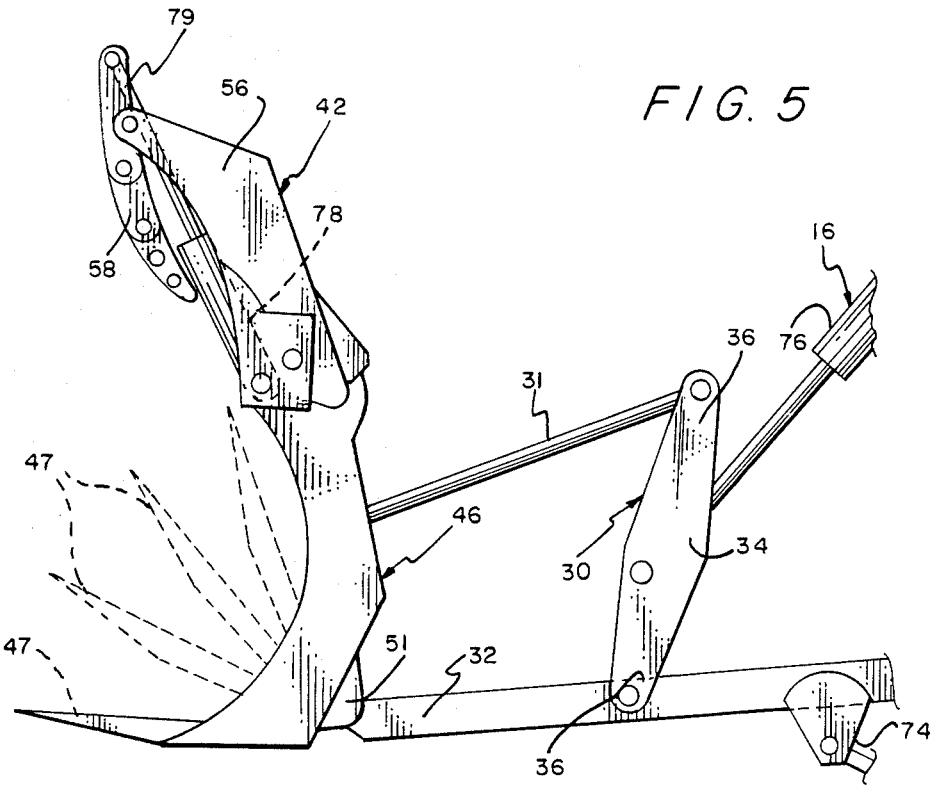

The lift arm assembly 48 includes a pair of tapered outwardly projecting finger members 47 having an inner end thereof pivotally connected to the lower anchor sections 51 so as to be pivotal upwardly in one direction as noted in dotted lines in FIGS. 4 and 5. The finger members 47 each include a body section 49 being tapered to an outer pointed end portion.

The main flexible jaw assembly 42 includes an upper jaw assembly 56 having a pivotal lift arm assembly 58 connected thereto. The upper jaw assembly 56 includes a pair of spaced movable jaw members 60 interconnected by spaced support shafts 62.

The pivotal lift arm assembly 58 includes a plurality of pivotal finger members 64 interconnected by spaced connector shafts 66. Each pivotal finger member 64 includes a main section 68 having an outer section 70 connected thereto. It is seen that the pivotal finger members 64 resemble the outer tapered finger portion on a person's hand being operable for the grasping of the material to be moved as will be explained.

The power actuator assembly 44 includes (1) a vertical actuator assembly 74; (2) a base actuator assembly 76; (3) a flex jaw actuator assembly 78; and (4) a flexible finger actuator assembly 79.

The vertical actuator assembly 74 includes a piston and cylinder member (not shown) which has a piston rod member 82 with an outer end section 84 for vertical movement of the interconnected lift links 32 of the lift linkage assembly 28 in a manner to be explained.

The base actuator assembly 76 includes a piston and cylinder assembly 86. The piston and cylinder assembly 86 includes a cylinder member 88 having a piston rod member 90 reciprocally mounted therein. The cylinder member 88 includes an outer connector section 92 pivotally connected to the prime mover 14.

The piston rod member 90 includes an outer end section 94 which is pivotally connected to the intermediate link member 34 for arcuate movement of the main bus assembly 46 as will be explained.

The flex jaw actuator assembly 78 includes a piston and cylinder member 96 having a cylinder member 98 with a piston rod member 100 axially and reciprocally movable therein. The cylinder member 98 includes a connector section 102 for anchoring to the main flexible jaw assembly 42. The piston rod member 100 has an outer end section 104 which is connected to the upper jaw assembly 56.

The flexible finger actuator assembly 79 includes a piston and cylinder member 112. The piston and cylinder member 112 includes a main cylinder member 114 having a piston rod member 116 reciprocally mounted therein. The piston rod member 116 includes an outer end section 120 which is pivotally connected to the pivotal lift arm assembly 58 for movement thereof as will be explained.

USE AND OPERATION OF THE INVENTION

In the use and operation of the quadflex bucket apparatus 12 of this invention, it is obvious that the same is readily attachable to a prime mover or front end loader 14 as noted in FIG. 1. The connection thereto, as best shown in FIG. 2, is through the lift linkage assembly 28 having the vertical lift links 32 and the connector rod 31 connected to the clamp link assembly 30. It is seen that the intermediate link member 34 is pivotally connected at the lower end to the parallel vertical lift links 32 and pivotally connected at the upper end to the connector rod 31. The base actuator assembly 76 is operable on axial movement of the piston rod member 90 to pivot the intermediate link member 34 about the lowermost pivotal connection to the vertical lift links 32 on movement thereof as shown by an arrow 106.

Additionally, it is seen that the vertical actuator 74 is operable through the movement of the piston rod member 82 to achieve pivotal movement of the interconnected vertical lift links 32 and, in turn, the entire quadflex bucket apparatus 12 of this invention as noted by an arrow 108.

Therefore, it is obvious from the use of the vertical actuator assembly 74 and the base actuator assembly 76 that the base support jaw assembly 40 can be moved vertically and in an arc as shown by the arrows 106 and 108 in FIG. 2.

Next, the flex jaw actuator assembly 78 is operable on actuation of the hydraulic control assembly 24 to move the piston rod 90 within the cylinder member 88 to achieve pivotal movement of the interconnected upper jaw assembly 56 as noted by an arrow 113.

The flexible finger actuator assembly 79 is operable through axial movement of the piston rod member 116 to achieve a pivotal movement of the pivotal lift arm assembly 58 as shown by an arrow 115 in FIG. 5.

In the most efficient use of the quadflex bucket apparatus 12 of this invention, it is readily operable in scrap metal areas in order to pick up extremely elongated materials or loose materials such as machine cut shavings which need to be grasped and moved to a different location or placed in railroad cars for transporting and the like. On initial forward movement of the prime mover 12, it is noted that the lift arm assembly 48 with the two finger members 47 are operable to be placed underneath a load to be moved. These are inserted under the loads similar to a fork lift structure with the prime mover 14 to receive the surplus material within and against the base support jaw assembly 40. However, it is to be noted that the finger members 47 are pivotal upwardly in an arc as shown by an arrow 17 so as to compensate for uneven ground surface or being under a certain portion of the load and such pivotal movement is noted in dotted lines in FIG. 5.

Additionally, the finger member 47 can be pivoted upwardly to a storage position within the confines of the outer jaw members 54 of the base support jaw assembly 40 when they are not needed for a particular operation.

On movement to a pile of scrap metal with the finger members 47 placed thereunder, it is obvious that the flexible jaw actuator assembly 78 and the flexible finger actuator assembly 79 can be operable through the respective piston and cylinder members and hydraulic control system so as to be placed about and grasp any scrap member so desired to be conveyed by the pivotal lift arm assembly 58 and upper jaw assembly 56. It is to be noted that such movement of the main flexible jaw assembly 42 is similar to the movement of the person's fingers so as to achieve a human like grasping of the material to be conveyed.

An important feature of this invention is that the base support jaw assembly 40 forms a scoop but permits a clear forward view between the jaw members 50 which is very important to the operation of the entire quadflex bucket apparatus 12. This allows the operator to clearly observe the material to be moved so as to properly operate the main flexible jaw assembly 42.

It is seen that the quadflex bucket apparatus of this invention is readily attachable to a prime mover structure; sturdy in construction; relatively easy to operate; and saves a considerable amount of labor and time in scrap piles of material. The power actuator assembly of the quadflex bucket apparatus of this invention is readily provided with the necessary control levers so as to readily control and move the entire quadflex bucket apparatus in an efficient and effective manner.

THE PREFERRED EMBODIMENT OF THE INVENTION OF FIGS. 6–22

Figure 6:
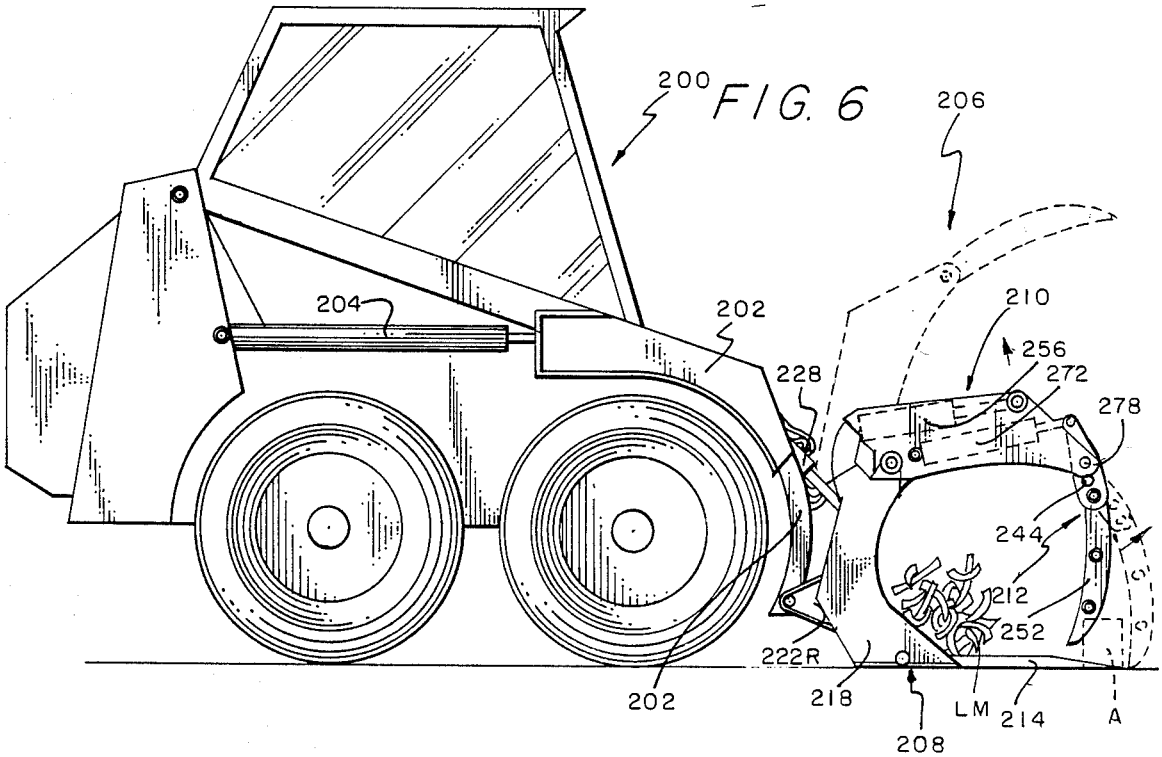
FIG. 6 is a side elevational view of a prime mover having secured thereto the quadflex bucket apparatus of this invention.
Figure 7:
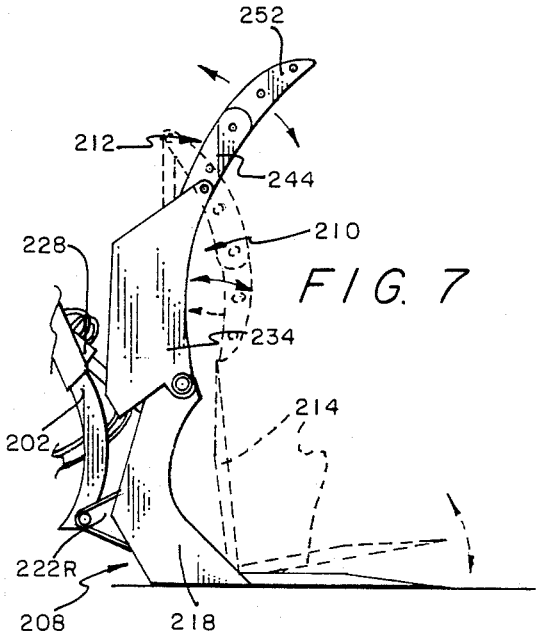
FIG. 7 is a side elevational view of the quadflex bucket apparatus in an open position.
Figure 8:
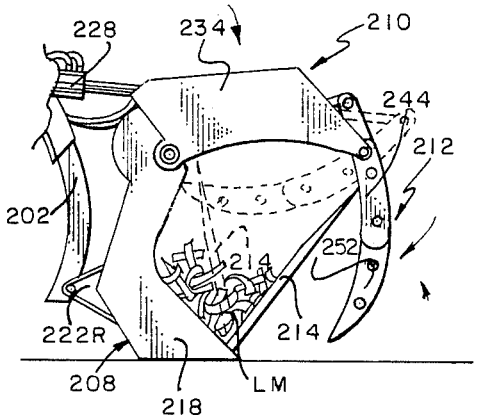
FIG. 8 is a side elevational view of the quadflex bucket apparatus being closed with the pair of fork or finger members being pivoted upwardly towards the dotted line position.
Figure 10:
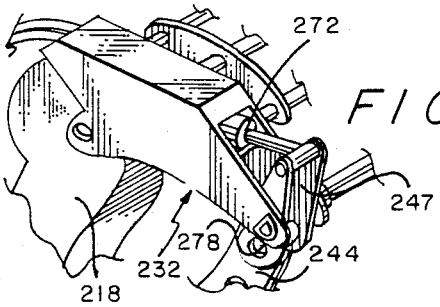
FIG. 10 is a perspective view of a hydraulic cylinder which is pivotally secured to the middle jaw member and the upper jaw member.
Figure 9:
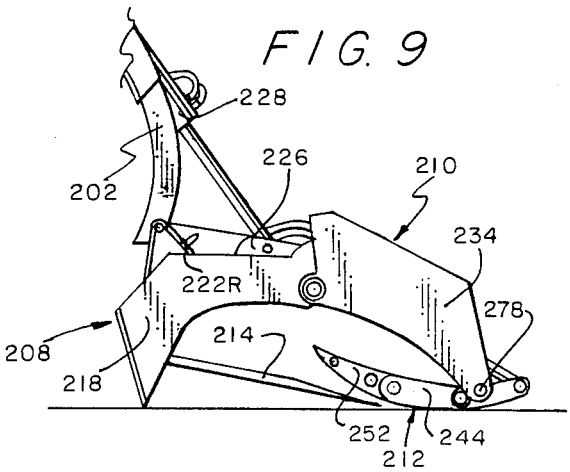
FIG. 9 is a side elevational view of the quadflex bucket apparatus expanded on the ground in one grasping position.

Referring in detail now to FIGS. 6–22 for a preferred embodiment of the present invention, there is seen a prime mover 200 (i.e., CATERPILLAR, tractor, or any of the like) with a pair of loader arms 202—202 (only one shown in FIG. 6) that operate by two hydraulic cylinders 204—204 (only one shown in FIG. 6). The two loader arms 202—202 function to raise or lower the quadflex bucket apparatus, identified generally as 206 in FIG. 6. The quadflex bucket apparatus 206 comprises a lower jaw assembly, generally illustrated as 208 (see FIG. 21); a middle jaw assembly, generally illustrated as 210 (see FIG. 20), pivotally secured to the lower jaw assembly; and an upper jaw assembly, generally illustrated as 212 (see FIG. 19), pivotally secured to the middle jaw assembly 210. A pair of finger members 214—214 is pivotally secured to a lower edge of the lower jaw assembly 208.

The lower jaw assembly 208 comprises a pair of outer lower shoe box means, each generally illustrated as 216. Each lower shoe box means 216 defines a pair of parallel lower shoe plates 218—218, and a bottom lower shoe plate 220 which interconnects the pair of lower shoe plates 218—218. One of the parallel lower shoe plates 218 is in an outermost lower shoe plate that defines a side of the lower jaw assembly 208. The lower jaw assembly 208 further includes a pair of lower connecting plates 222—222 with one of the lower connecting plates 222 juxtaposed to one of the lower shoe box means 216 and the other lower connecting plate 222 juxtaposed to the other of the shoe box means 216. The lower jaw assembly 208 further includes a pair of parallel lower horizontal support members 224—224 that are connected to and pass into the pair of lower shoe box means 216—216 to flush against each of the outermost shoe plates 218. A lower middle plate 226 is provided in order that a loader hydraulic cylinder means 228 (see FIGS. 6–9) can be pivotally secured thereto. The loader hydraulic cylinder means 228 functions to rotate the quadflex bucket apparatus 10 of this invention. The lower middle plate 226 is secured to the pair of lower horizontal support members 224—224. A plurality of lower vertical splines 230 connect to the pair of lower horizontal support members 224—224 in order to provide rigidity for the lower jaw assembly 208. The pair of connecting plates 222—222 are pivotally secured respectively to the pair of loader arms 202—202. As best illustrated in FIG. 21, the lower jaw assembly 208 additionally comprises a wear plate 219, approximately ½ inch high or thick by 6 inches wide which connects the bottom of the connecting plates 222, splines 230, and the middle plates 226. The wear plate 219 prevents the wearing of the ends of the connecting plates 222, splines 230, and middle plate 226. Thus, the connecting plates 222, the splines 230, and the middle plates 226 terminate on (or on top of) the wear plate 219.

The middle jaw assembly 210, as best illustrated in FIG. 20, has a pair of outer intermediate shoe box means, each generally illustrated as 232. Each of the intermediate shoe box means 232 defines a pair of parallel intermediate shoe plates 234—234, and an intermediate brace 236 that interconnects the pair of parallel intermediate shoe plates 234—234. One of the parallel intermediate shoe plates 234 defines a side of the middle jaw assembly 210. The middle jaw assembly 210 further comprises a plurality of intermediate horizontal support members 238 connected to the pair of intermediate shoe box means 232—232. The middle jaw assembly 210 further comprises a plurality of intermediate vertical splines 240 connected to the plurality of intermediate horizontal support members 238. In a preferred embodiment of the invention, the middle jaw assembly 210 has five intermediate horizontal support members 238 and five intermediate vertical splines 240. Two of the five intermediate vertical splines 240 are connected to the five intermediate horizontal support members 238, and three of the five intermediate vertical splines 240 are connected to three of the five intermediate horizontal support members 238, all as illustrated in FIG. 20.

The upper jaw assembly 212 includes a pair of outer upper shoe box means, each generally illustrated as 242 with each upper shoe box means 242 defining a pair of parallel upper shoe plates 244—244, and an upper brace plate 246 connecting each pair of parallel upper shoe plates 244—244 together in a spaced relationship, as illustrated in FIG. 19. One of the parallel upper shoe plates 244 is the outermost upper shoe plate 244 defining part of a side of the upper jaw assembly 212. The upper jaw assembly 212 additionally includes a plurality of upper horizontal support members 248. Preferably, there are four upper horizontal support members 248, all of which are in a general parallel relationship with respect to each other. Two of the four parallel upper horizontal support members 248 are connected to and pass into the pair of upper shoe box means 242—242 to flush against each of the outermost upper shoe plate 244. A pair of end formers 252—252 are secured to the upper horizontal support members 248 with one end former 252 being disposed between one pair of parallel upper shoe plates 244—244 and extending away therefrom to form a remaining part of one of the sides of the upper jaw assembly 212. The other upper end former 252 is disposed between the other pair of parallel upper shoe plates 244—244 and also extend away therefrom to form a remaining part of the other side of the upper jaw assembly 212. Thus, the sides of the upper jaw assembly 212 are formed by the end formers 252—252 and the outermost upper shoe plate 244—244. A plurality of upper vertical splines 250 are connected to the upper horizontal support members 248; and a plurality of serrated blades 254 are secured to one of the upper horizontal support members 248 to define a plurality of upper teeth for the upper jaw assembly 212.

The quadflex bucket apparatus 206 additionally comprises a pair of hydraulic cylinder means 256—256 which are pivotally connected to both the lower jaw assembly 208 and the middle jaw assembly 210. More specifically, the lower part of hydraulic cylinder means 256 is pivotally connected to the lower jaw assembly 208 along axis 258 (see FIG. 21). The upper part of the hydraulic cylinder means 256 is pivotally connected to the middle jaw assembly 210 along axis 270 (see FIG. 20). The lower jaw assembly 208 is pivotally secured to the middle jaw assembly 210 by a bushing 262 that pivotally secures to the middle jaw assembly 210 along the axis 276. The two bushings 262—262 are secured on or to the lower shoe plates 218—218 of the lower shoe box means 216—216 as shown in FIG. 21.

Pivotally secured to the middle jaw assembly 210 along axis 270—270 is the bottom of a pair of hydraulic cylinders 256—256. The top of hydraulic cylinders 272—272 is pivotally secured to the upper jaw assembly 212 along axis 274—274. The middle jaw assembly 210 pivotally connects to bushings 278—278 on the upper jaw assembly 212. More specifically, bushings 278—278 pivotally lodge along axis 264—264 of the middle jaw assembly 210 in order to pivotally secure the middle jaw assembly 210 to the upper jaw assembly 212.

The two pair of hydraulic cylinders 256—256 and 272—272 pivot the various jaw assemblies 208, 210, and 212 among and with respect to each other. As was indicated, hydraulic cylinder 256 is pivotally secured to the lower jaw assembly 208 along axis 258 between the pair of parallel lower shoe plates 218—218 and at the end thereof (see FIG. 21) of the pair of lower shoe box means 216—216. The pair of hydraulic cylinders 256—256 is further pivotally secured respectively to the middle jaw assembly 210 along axis 270 between the pair of parallel intermediate shoe plates 234—234 of the pair of intermediate shoe box means 232—232. Furthermore, the pair of hydraulic cylinders 272—272 is pivotally secured respectively to the middle jaw assembly 210 along axis 260 between the pair of parallel intermediate shoe plates 234—234 of the pair of intermediate shoe box means 232—232.

The quadflex bucket apparatus 206 of this invention additionally comprises a boot, generally illustrated as 300 in FIG. 12. The boot 300 is slidably disposed over each of the lower shoe box means 216. Each boot means 300 comprises a bottom 302, a pair of side walls 304—304 secured to the bottom 302, a front wall 306 secured to the pair of side walls 304—304 and the bottom 302, and a cutaway or partial top 308 which is secured to the front wall 306 and the pair of side walls 304—304. Protruding through the front wall 306 of the boot 300 is a projecting front ripping finger 310 which extends outwardly from the boot 300. A side ripping finger 312 is pivotally secured to one of the side walls 304 such as to be disposed with respect to the side wall 304 in various positions, such as perpendicular thereto or flushed thereagainst. As was previously indicated, the top 308 is a partial top and does not cover the entire bottom 302 in order that the toe of the lower shoe box means 216—216 can slide within the opening over the bottom 302 that is not covered, comparable to one slipping his foot into a slipper. Thus, the pair of side walls 304—304 are on the outside of the lower shoe box means 216. Each of the side walls 304 of the boot 300 has an aperture 305 wherethrough a bolt 307 or the like passes to secure the boot 300 to the lower toe or foot of the lower shoe box means 216.

Figure 23:
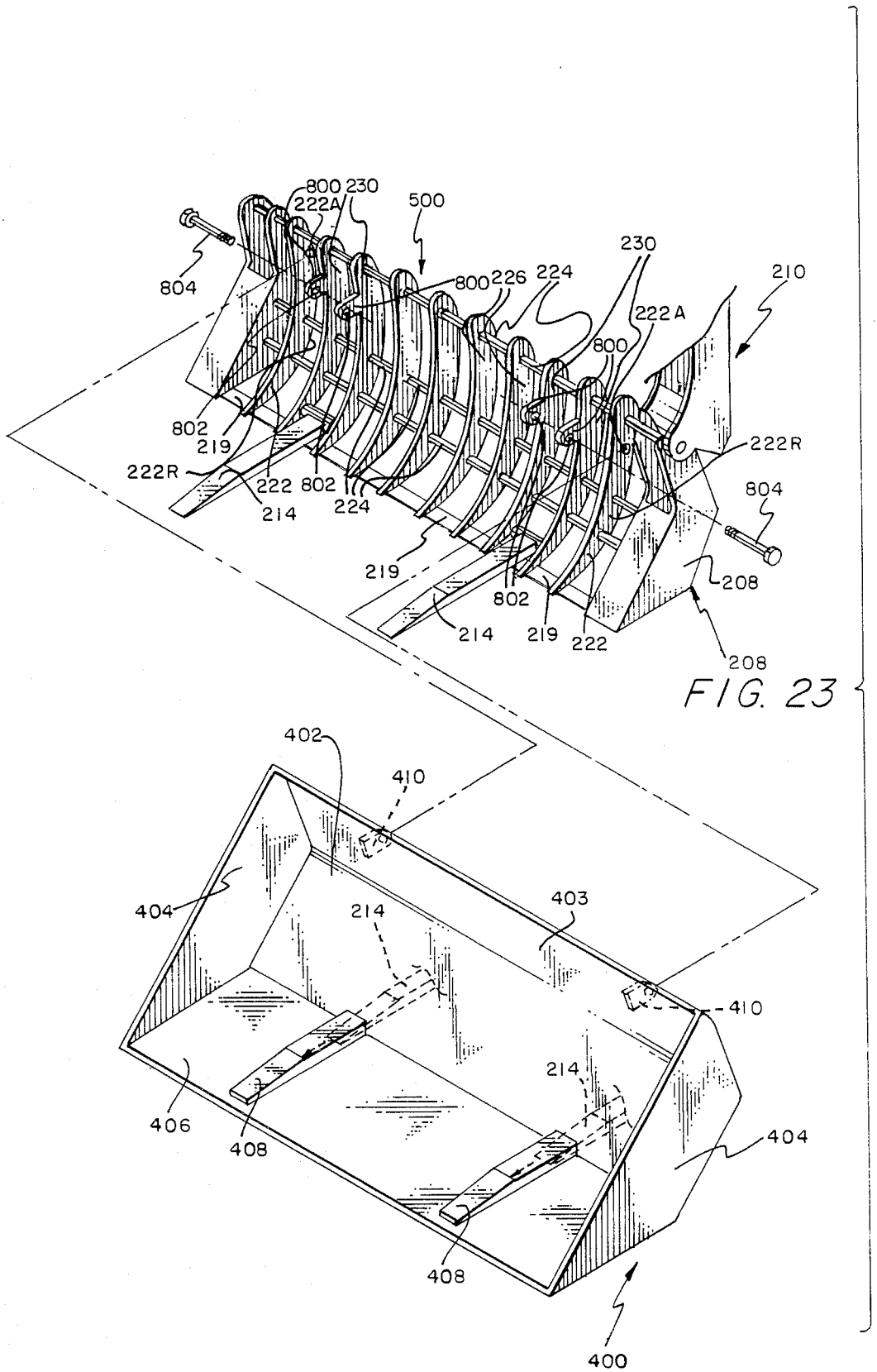
FIG. 23 is a perspective view of a quadflex sand liner that mounts removably to the lower jaw assembly as indicated by the broken lines.

The quadflex bucket apparatus 206 of this invention further comprises a grading assembly, generally illustrated as 320 in FIG. 16. The grading assembly 320 has an arcuate shaped blade 322, a pair of lower brackets 324—324 secured to the arcuate blade, and a pair of upper brackets 326—326 also secured to the arcuate blade 322. As shown in FIG. 18, the brackets 324 and 326 are generally aligned with respect to each other on a side of the arcuate blade 322. The pair of lower brackets 324—324 and the pair of upper brackets 326—326 secure to two of the plurality of upper vertical splines 250 of the upper jaw assembly 212. Each of the lower brackets 324 includes an aperture 325 wherethrough a bolt 327 or the like passes for securing the lower bracket 324 to the vertical spline 250. Similarly, each of the upper brackets 326 has an aperture passing therethrough in order that a bolt 329 can pass in order to secure the upper brackets 326—326 to a pair of vertical splines 250—250. The pair of fingers 214—214 (or forks) lodge behind the blade 322 and contiguous to the pair of lower brackets 324—324 as indicated by the dotted line position in FIG. 18. The pair of fingers 214—214 enable the grading assembly 320 to be able to push heavy loads without collapsing the upper jaw assembly 212 by acting as a rear brace when the grading assembly 320 lodges against the ends of the fingers 214—214. The quadflex bucket apparatus 206 of this invention still further optionally comprises (as best shown in FIG. 23) a quadflex and liner, lgenerally illustrated as 300, having a solid back 302, a pair of walls 304—304 secured to the back 302, and a solid floor 306 secured to both the pair of walls 304—304 and the solid back 302. The floor 306 has a pair of hollow shoes 308—308 open behind the solid back 302 for slidably receiving therein the finger members 214—214. The rear of the back 302 has a pair of pin mounts 310—310 which is for securing the sand liner 300 to the two lower connecting plates 222—222.

While the invention has been described with preferred specific embodiments thereof, it is to be understood that this description is intended to illustrate and not to limit the scope of the invention, which is defined by the following claims.

I claim:

1. A quadflex bucket apparatus operable to grasp and lift loose piles of material comprising a lower jaw assembly having an upper part and a lower part, said lower jaw assembly having a plurality of lower horizontal support members and a plurality of lower vertical splines secured to said lower horizontal support members, said lower jaw assembly comprising a pair of outer lower box means with each lower box means defining a pair of parallel lower plates, one of said parallel plates in each pair being an outermost lower plate defining a side of the lower jaw assembly;

at least two finger members pivotally coupled to said lower vertical splines in the lower part of said lower jaw assembly;

a middle jaw assembly pivotally secured to the lower jaw assembly and comprising a plurality of intermediate horizontal support members and a plurality of intermediate vertical splines connected to the plurality of intermediate horizontal support members;

an upper jaw assembly pivotally secured to the middle jaw assembly and comprising a plurality of upper horizontal support members and a plurality of upper vertical splines connected to the plurality of upper horizontal support members;

a pair of first cylinder means pivotally secured to said upper part of said lower jaw assembly and to said middle jaw assembly; and a pair of second cylinder means pivotally secured to said middle jaw assembly and to said upper jaw assembly.

2. The quadflex bucket apparatus of claim 1 wherein a bottom lower plate interconnects said pair of parallel lower plates.

3. The quadflex bucket apparatus of claim 2 wherein said lower jaw assembly comprises a pair of lower connecting plates with one of said lower connecting plates juxtaposed to one of said box means and the other of said lower connecting plates juxtaposed to the other of said box means; and said lower horizontal support members connect to and pass into the pair of box means to flush against each of the outermost lower plates; and a lower middle plate means secured to the lower horizontal support members for pivotally supporting a loader hydraulic cylinder means for rotating the quadflex bucket apparatus.

4. The quadflex bucket apparatus of claim 1 wherein said middle jaw assembly comprises a pair of outer intermediate box means with each defining a pair of parallel intermediate plates and an intermediate brace interconnecting the pair of parallel intermediate plates, one of said parallel intermediate plates in each pair being an outermost intermediate plate defining a side of the middle jaw assembly.

5. The quadflex bucket apparatus of claim 4 wherein said upper jaw assembly comprises a pair of outer upper box means with each upper box means defining a pair of parallel upper plates and an upper brace plate interconnecting said upper plates in a spaced relationship, one of said parallel upper plates in each pair being an outermost upper plate defining part of a side of the upper jaw assembly.

6. The quadflex bucket apparatus of claim 4 wherein said pair of first cylinder means is pivotally secured respectively to said lower jaw assembly between and at an end of said pair of parallel lower plates of each of said pair of lower box means, and said pair of first cylinder means is further pivotally secured respectively to said middle jaw assembly betwen said pair of parallel intermediate plates.

7. The quadflex bucket apparatus of claim 6 wherein said pair of second cylinder means is pivotally secured respectively to said upper jaw assembly between and at an end of said pair of parallel upper plates and of each of said upper box means, and said pair of second cylinder means is further pivotally secured respectively to said middle jaw assembly between said pair of parallel intermediate shoe plates.

8. The quadflex bucket apparatus of claim 2 additionally comprising a boot means slidably disposed over each of said lower box means, said boot means comprising a projecting front ripping finger protruding outwardly therefrom, and a side rapping finger pivotally secured thereto.

9. The quadflex bucket apparatus of claim 1 additionally comprising a grading assembly secured to said upper jaw assembly.

10. The quadflex bucket apparatus of claim 9 wherein said grading assembly comprises an arcuate blade, a pair of lower brackets secured to said arcuate blade and to two of said plurality of upper vertical splines and a pair of upper brackets secured to said arcuate blade and to said two upper vertical splines to which said lower brackets are secured.

11. The quadflex bucket apparatus of claim 1 wherein said lower jaw assembly additionally comprises a wear plate secured to said lower vertical splines.

12. The quadflex bucket apparatus of claim 1 additionally comprising a sand liner slidably disposed on the two finger members.

* * * * *